US010587062B2

(12) United States Patent
Stack et al.

(10) Patent No.: US 10,587,062 B2
(45) Date of Patent: Mar. 10, 2020

(54) HOUSING POST FOR AN ELECTRICAL ASSEMBLY

(71) Applicant: TE CONNECTIVITY CORPORATION, Berwyn, PA (US)

(72) Inventors: Daniel Franklin Stack, Kernersville, NC (US); David Allen Klein, Kernersville, NC (US)

(73) Assignee: TE Connectivity Corporation, Berwyn, PA (US)

( * ) Notice: Subject to any disclaimer, the term of this patent is extended or adjusted under 35 U.S.C. 154(b) by 0 days.

(21) Appl. No.: 16/043,866

(22) Filed: Jul. 24, 2018

(65) Prior Publication Data

US 2020/0036120 A1 Jan. 30, 2020

(51) Int. Cl.
*H01R 12/70* (2011.01)
*H01R 43/00* (2006.01)

(52) U.S. Cl.
CPC ..... *H01R 12/7011* (2013.01); *H01R 43/00* (2013.01)

(58) Field of Classification Search
CPC ..... H01R 12/00; H01R 12/7035; H01R 12/73
USPC ..... 439/567, 571, 926
See application file for complete search history.

(56) References Cited

U.S. PATENT DOCUMENTS 3,966,290 A * 6/1976 Little ..... H01R 12/727 439/74
4,439,000 A * 3/1984 Kaufman ..... H01R 12/714 439/62
5,147,225 A * 9/1992 Kile ..... H01R 12/716 439/374
5,336,110 A * 8/1994 Mosquera ..... H01R 12/7064 439/554
5,368,802 A 11/1994 Wanha
5,542,860 A 8/1996 Bandura et al.
6,435,897 B1 * 8/2002 Paul ..... H01R 12/7005 439/374
6,805,278 B1 * 10/2004 Olson ..... H01R 43/0256 228/180.22

(Continued)

FOREIGN PATENT DOCUMENTS

GB 2255678 A 11/1992
JP H03276582 A 12/1991
JP S61146881 U 9/1996

OTHER PUBLICATIONS

European Search Report dated Nov. 27, 2019 in corresponding European Application No. 19187063.3; total 9 pages.

*Primary Examiner* — Hien D Vu
(74) *Attorney, Agent, or Firm* — Snell & Wilmer L.L.P.

(57) ABSTRACT

An electrical assembly includes a housing extending between front and rear ends. The housing includes a post extending between a base end and a free that is loaded into a passage of the circuit board and engages the circuit board in a primary locking operation such that the post secures the housing to the board by a primary holding force. A contact is received in the housing and has a mating end at the front end of the housing for mating with a mating electrical assembly and a terminating end at the rear end of the housing for electrical connection with the board. The free end of the post is locked to the rear side of the board by a secondary locking operation that secures the housing to the board by a secondary holding force that is greater than the primary holding force.

11 Claims, 9 Drawing Sheets

(56) References Cited

U.S. PATENT DOCUMENTS 7,029,333 B2 * 4/2006 Shimizu ..... H01R 43/18
439/636
7,867,023 B2 * 1/2011 Keyser ..... H05K 5/0069
439/567

* cited by examiner

HOUSING POST FOR AN ELECTRICAL ASSEMBLY

BACKGROUND OF THE INVENTION

The subject matter herein relates generally to electrical assemblies.

Electrical assemblies are used in various system applications. For example, header assemblies are typically mounted to a panel or a circuit board for mating with other electrical assemblies, such as plug connectors mated with the header assemblies. The header assemblies include contacts held within a housing and disposed on a first side of a circuit board. The housing is mounted to the circuit board, such as by a press-fit connection. For example, the housing includes posts having ribs that are press-fit into corresponding openings of the circuit board. Similarly, the contacts are terminated to the circuit board, such as by a press-fit connection or a solder connection.

However, known housings are not without disadvantages. For instance, the housing posts that are press-fit to the circuit board may become loose when the electrical assembly is subjected to vibrations during manufacturing, shipping, or operation of equipment. The loosening of the housing may cause wear or damage to the electrical connection between the contacts and the circuit board. The electrical assembly may lose stability over time.

A need remains for a housing that may be secured to a circuit board in a reliable manner.

BRIEF DESCRIPTION OF THE INVENTION

In one embodiment, an electrical assembly is provided including a housing having a body extending between a front end and a rear end. The front end mates with a mating electrical assembly and the rear end includes a mating surface that is coupled to a front side of a circuit board. The housing includes a post extending therefrom between a base end at the mating surface and a free end disposed a distance away from the mating surface. The housing is disposed on the front side of the circuit board such that the post is loaded into a passage of the circuit board and engages the circuit board in a primary locking operation such that the post secures the housing to the circuit board by a primary holding force. The electrical assembly also includes a contact received in the housing. The contact has a mating end accessible at the front end of the housing for mating with the mating electrical assembly and a terminating end accessible at the rear end of the housing for electrical connection with the circuit board. The free end of the post is locked to the rear side of the circuit board by a secondary locking operation. The secondary locking operation secures the housing to the circuit board by a secondary holding force that is greater than the primary holding force.

In one embodiment, an electrical assembly is provided including a housing having a body extending between a front end and a rear end. The front end mates with a mating electrical assembly and the rear end includes a mating surface that is coupled to a front side of a circuit board. The housing includes a post extending therefrom between a base end at the mating surface and a free end disposed a distance away from the mating surface. The housing is disposed on the front side of the circuit board such that the post is loaded into a passage of the circuit board and engages the circuit board in a primary locking operation such that the post secures the housing to the circuit board by a primary holding force. The electrical assembly also includes a contact received in the housing. The contact has a mating end accessible at the front end of the housing for mating with the mating electrical assembly and a terminating end accessible at the rear end of the housing for electrical connection with the circuit board. The free end of the post is locked to the rear side of the circuit board by a secondary locking operation. The secondary locking operation secures the housing to the circuit board by a secondary holding force that is greater than the primary holding force. The secondary locking operation consists of staking the free end of the post.

In another embodiment, a method is provided including positioning a housing on a front side of a circuit board. The circuit board having the front side and an opposite rear side with a passage extending therethrough. The housing includes a body extending between a front end and a rear end. The front end is mated with a mating electrical assembly. The rear end includes a mating surface that is coupled to the front side of the circuit board. The housing includes a post extending therefrom between a base end at the mating surface and a free end disposed a distance away from the mating surface. The method also including press-fitting the post of the housing within the passage of the circuit board such that the post is loaded into the passage of the circuit board and engages the circuit board in a primary locking operation. The post extends beyond the rear side of the circuit board to temporarily hold the housing on the circuit board by a primary holding force.

DETAILED DESCRIPTION OF THE INVENTION

Figure 1:
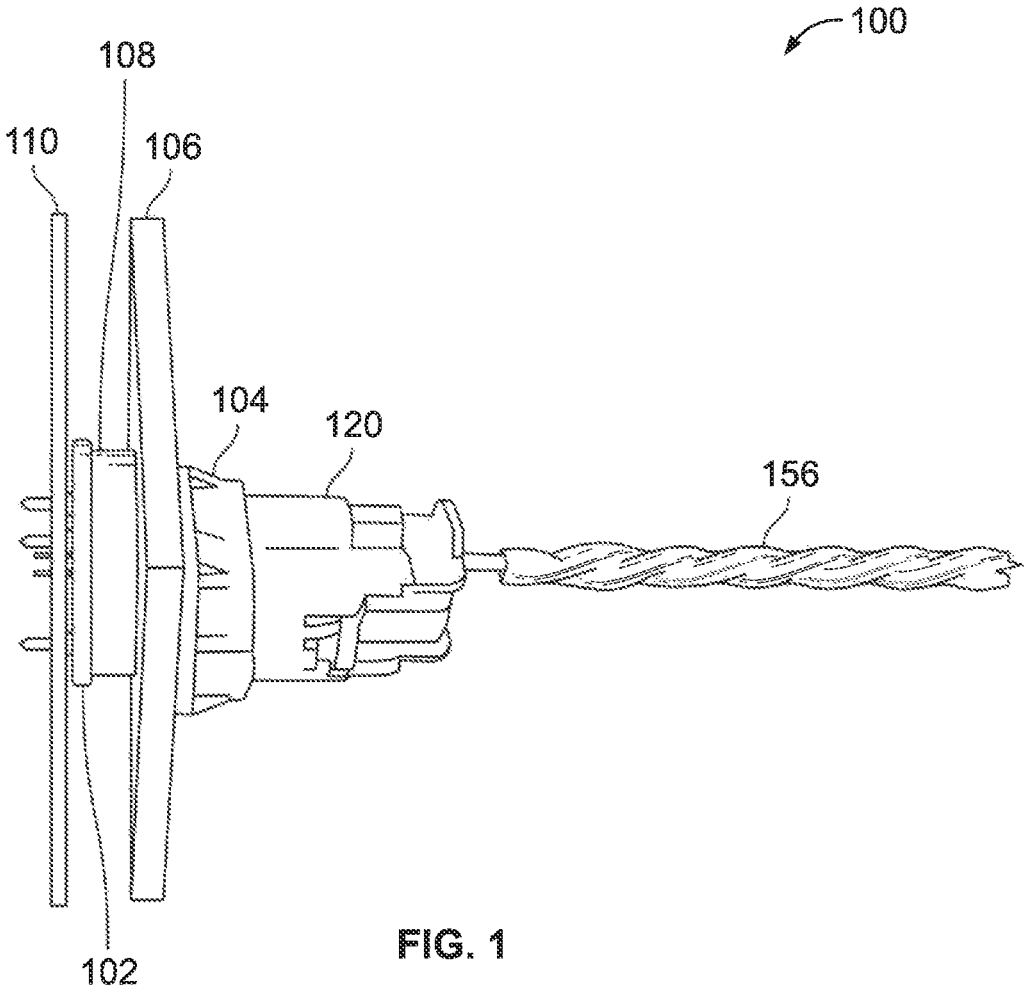
FIG. 1 is a perspective view of an electrical assembly in accordance with an exemplary embodiment.
Figure 2:
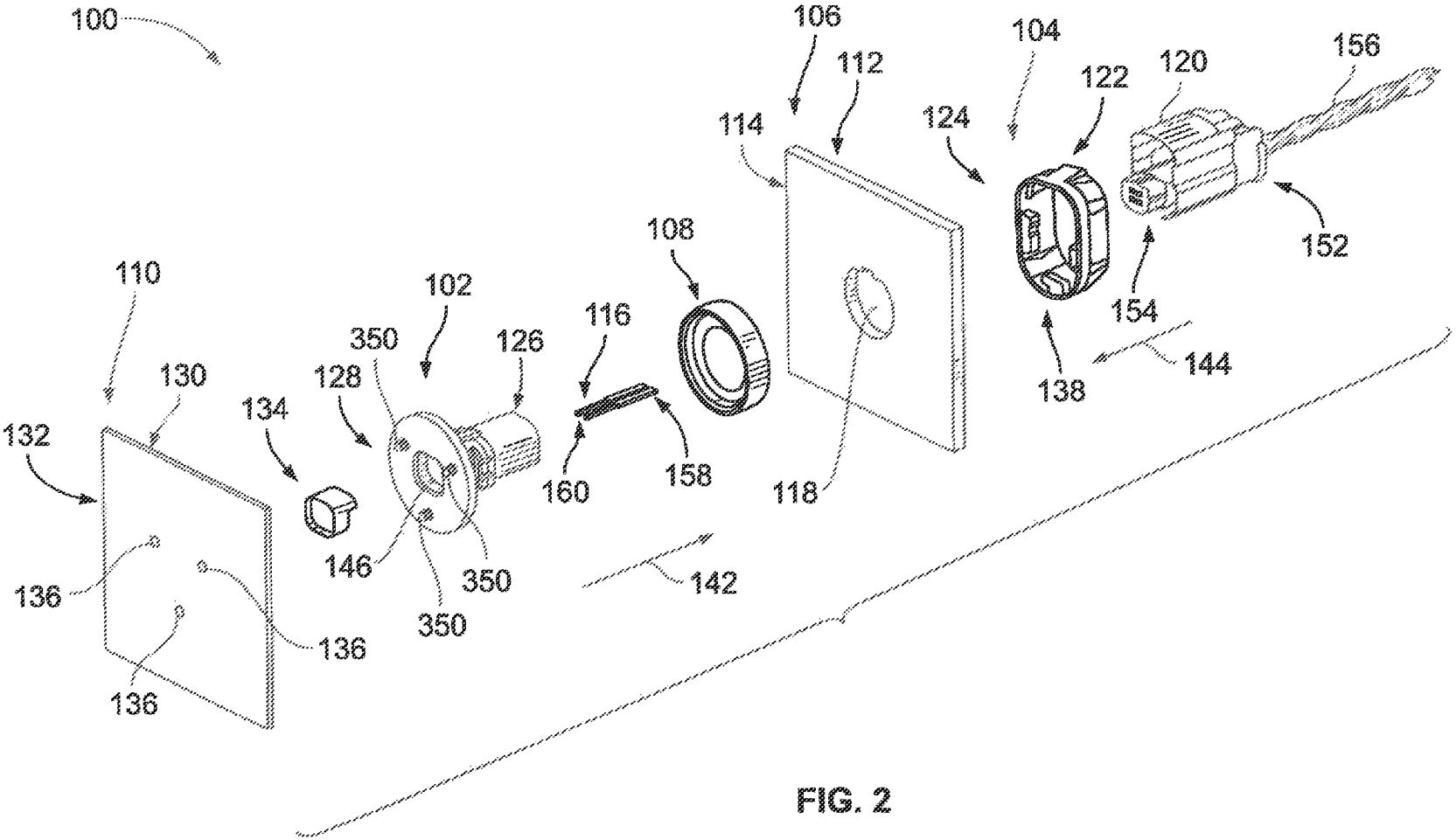
FIG. 2 is an exploded view of the electrical assembly of FIG. 1 in accordance with an exemplary embodiment.

FIG. 1 is a perspective view of an electrical assembly 100 in accordance with an exemplary embodiment. FIG. 2 is an exploded view of the electrical assembly 100. The electrical assembly 100 includes a housing 102 having contacts 116. The housing 102 is configured to be mounted to a circuit board 110. In an exemplary embodiment, the electrical assembly 100 is a panel mounted assembly configured to be secured to a panel 106 with a mounting clip 104; however the electrical assembly 100 may be provided without the panel 106 and the mounting clip 104 in alternative embodiments. The electrical assembly 100 is used to electrically connect a mating electrical assembly 120 to the circuit board 110. In the illustrated embodiment, the electrical assembly 100 is used to electrically connect the mating electrical assembly 120 with the circuit board 110 on opposite sides of the panel 106.

The housing 102 includes a mating or front end 126 and a rear end 128. The housing 102 is inserted into an opening 118 of the panel 106 that extends between a front side 112 and a rear side 114. For example, the panel 106 may be a plate, a circuit board, or any alternative surface. During assembly of the electrical assembly 100, the housing 102 is loaded into the panel 106 in a loading direction 142 such that the front end 126 or the mating end of the housing 102 extends through the opening 118 and extends a distance away from the front side 112 of the panel 106.

The mounting clip 104 is disposed on the front side 112 of the panel 106 and engages with the front end 126 of the housing 102 to secure the housing 102 to the panel 106. The mounting clip 104 includes a body 138 that extends between a front end 122 and a rear end 124. The rear end 124 of the mounting clip 104 is disposed at the front side 112 of the panel 106. When assembled, the front end 126 of the housing 102 is received into the mounting clip 104 at the rear end 124 of the mounting clip 104. For example, the mounting clip 104 moves in a mounting direction 144 towards the front side 112 of the panel 106 and engages with the front end 126 of the housing 102.

The front end 126 of the housing 102 receives the mating electrical assembly 120 on the front side 112 of the panel 106 and the rear end 128 of the housing 102 is coupled with the circuit board 110. The mating electrical assembly 120 includes a mating end 154 that engages with the front end 126 of the housing 102 during the mating operation. The mating assembly 120 includes a cable end 152 from which one or more electrical cables 156 protrude. The cables 156 may be terminated to electrical contacts (not shown) held within the mating electrical assembly 120. In the illustrated embodiment, the mating electrical assembly 120 is an inline or linear connector. Alternatively, the mating assembly 120 may be an angled connector such as a right angle connector, 45 degree connector, printed circuit board headers, or the like having the cables 156 extending in varying directions relative to the mating end 154.

The electrical assembly 100 includes contacts 116 that are disposed inside the housing 102. The contacts 116 extend between the front end 126 and the rear end 128 of the housing 102. For example, the contacts 116 may be held within one or more channels inside the housing 102, may be held by clips or fasteners inside the housing 102, may be molded inside the housing 102, may be stitched with the housing 102, or the like. Each of the contacts 116 includes a mating end 158 and a terminating end 160. In the illustrated embodiment, the contacts 116 include pins at both the mating and terminating ends 158, 160, however the contacts 116 may have other mating interfaces at either or both ends in alternative embodiments.

The contacts 116 electrically connect the mating electrical assembly 120 with the circuit board 110. For example, the mating ends 158 of the contacts 116 are electrically connected to the mating assembly 120 inside the front end 126 of the housing 102 and the terminating ends 160 of the contacts 116 are electrically connected to the circuit board 110. The terminating ends 160 may be press fit to the circuit board 110, such as in plated vias. The terminating ends 160 may be soldered to the circuit board 110, such as to pads, traces, or vias of the circuit board 110. In the illustrated embodiment, the electrical assembly 100 includes two contacts 116. However, the assembly 100 may include any number of contacts 116 that may have any alternative shape and/or size such that the contacts 116 may electrically connect the mating electrical assembly 120 with the circuit board 110, in alternative embodiments.

In an exemplary embodiment, the electrical assembly 100 includes a flange seal 108 that forms a seal between the housing 102 and the rear side 114 of the panel 106. For example, the mating or front end 126 may extend through the flange seal 108 when the housing 102 is assembled to the rear side 114 of the panel 106. In the illustrated embodiment, the flange seal 108 has a circular cross-sectional shape; however the seal 108 may have any alternative shape and/or size. The flange seal 108 may be manufactured of a material such that the flange seal 108 forms an environmental seal between the housing 102 and the rear side 114 of the panel 106. For example, the flange seal 108 may be manufactured of a non-conductive flexible rubber or plastic material. Optionally, the flange seal 108 may form an environmental seal between the housing 102 and the panel 106. For example, the flanges seal 108 may be manufactured of conductive plastic, a dielectric elastomeric material, or the like.

In one or more embodiments, the electrical assembly 100 includes two or more flange seals 108. For example, one flange seal 108 may be disposed between the mounting clip 104 and the front side 112 of the panel and one flange seal 108 may be disposed between the rear side 114 of the panel 106 and the housing 102 in order to provide an environmental seal between two or more components of the electrical assembly 100. Optionally, a flange seal 108 may form a seal around the perimeter of the inside of the passage 118 of the housing 102. For example, a ring seal, such as an o-ring or the like, may be positioned inside the passage 118 around the perimeter of the passage 118 between the front and rear sides 112, 114 of the panel 106. In an exemplary embodiment, the electrical assembly 100 also includes a sealant 134 disposed at the front side 130 of the circuit board 110. For example, the sealant 134 may be disposed inside a channel 146 of the housing 102 at the rear end 128 of the housing 102 to provide an environmental seal and/or an electromagnetic seal between the housing 102 and the circuit board 110. In the illustrated embodiment, the sealant 134 is shaped and sized to be received inside the channel 146, and includes one or more passages (not shown in FIG. 2) extending through the sealant 134 in which the contacts 116 may extend therethrough between the housing 102 and the circuit board 110.

In one or more embodiments, the electrical assembly 100 may include one or more springs (not shown) that may be disposed between the front side 112 of the panel 106 and the clip 104, between the rear side 114 of the panel 106 and the housing 102, or at any alternative position. For example, a spring may be compressible between the front side 112 of the panel 106 and the mounting clip 104 to bias the mounting clip 104 away from the panel 106. Optionally, a spring may be compressible between the rear side 114 of the panel 106 and the housing 102 to bias the housing 102 away from the panel 106. The springs may be wave springs, leaf springs, standard compression or tension springs, or the like. The springs may be assembled with or attached to the clip 104 and/or the housing 102 by a snap assembly, overmolding, riveting, heat staking, or the like.

Figure 3:
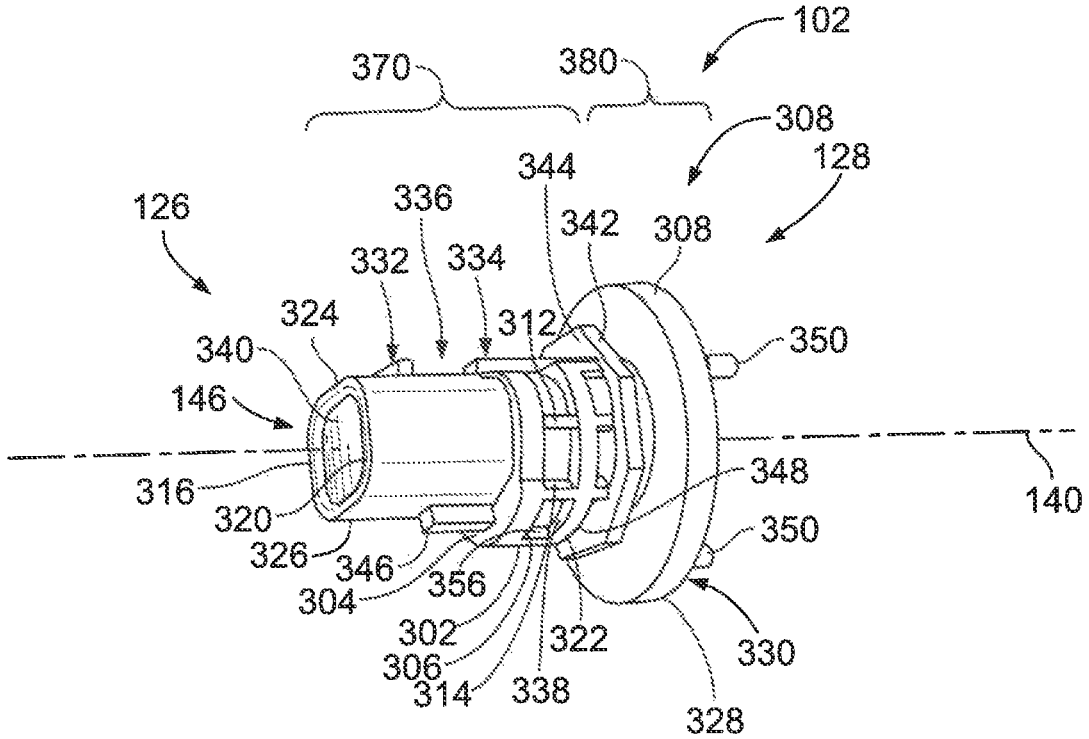
FIG. 3 is a perspective view of a housing in accordance with an exemplary embodiment.

FIG. 3 is a perspective view of the housing 102 in accordance with an exemplary embodiment. The housing 102 has a housing body 318 that extends from the mating or front end 126 to the rear end 128 along a mating axis 140. The housing body 318 also includes a first side 316 and a second side 320 that are connected by a top side 324 and a bottom side 326. In the illustrated embodiment, the housing 102 includes an interior surface 340 defining the channel 146 that is disposed at the front end 126 and extends into the body 318 of the housing 102. The channel 146 may extend the entire distance or at least a part of the distance into the housing 102 towards the rear end 128. Optionally, the housing 102 may include any number of channels or passages extending any distance between the front end 126 and the rear end 128, and may include electrical contacts, wires, fasteners, locking features, or the like, disposed inside the housing 102. The channel 146 receives the contacts 116, such that the contacts 116 may electrically connect the mating electrical assembly 120 with the circuit board 110 (illustrated in FIGS. 1 and 2).

The housing 102 includes alignment protrusions or alignment notches 332, 334 that are disposed at the top side 324 of the housing 102 and engage with an alignment notch of the mounting clip 104 when the mounting clip 104 is coupled with the housing 102. The alignment notches 332, 334 may be negative shapes, such as grooves, or positive shapes, such as bumps, and the corresponding alignment notch of the mounting clip 104 may have a mating male or female corresponding shape. In the illustrated embodiment, the alignment notches 332, 334 are separated from each other in a direction along the mating axis 140 by a channel 336. For example, the alignment notch 332 may double as an alignment feature to align the mounting clip 104 with the housing 102 and as a latching feature to latch the mating electrical assembly 120 to the housing 102. Optionally, the housing 102 may include a single alignment notch that extends along the top side 324 of the housing 102 or along any alternative side of the housing 102 that may align the housing 102 with the mounting clip 104 and may latch the mating electrical assembly 120 to the housing 102. The housing 102 also includes an alignment notch 346 on the bottom side 326 that may engage with an alignment notch or anti-rotation feature (not shown) of the mating electrical assembly 120 when the mating electrical assembly 120 is coupled with the housing 102.

The alignment notches 332, 334 at the top side 324 of the housing 102 orient the housing 102 with respect to the opening 118 of the panel 106 and orient the mounting clip 104 with respect to the housing 102. The alignment notch 332 at the top side 324 of the housing 102 and the alignment notch 346 at the bottom side 326 of the housing 102 orient the housing 102 with respect to the mating electrical assembly 120. Optionally, the housing 102, the mounting clip 104, the opening 118 of the panel 106, and/or the mating electrical assembly 120 may include any alternative alignment features having any alternative shape and/or size.

The housing 102 includes a first flange 302 and a second flange 322. The first flange 302 is disposed closer to the front end 126 of the housing 102 than the second flange 322. The first flange 302 includes a front surface 304 and a rear surface 306. Similarly, the second flange 322 includes a front surface 338 and a rear surface 348. The first and second flanges 302, 322 extend around the perimeter of the body 318 of the housing 102 about the mating axis 140. Optionally, the first or second flanges 302, 322 may extend only part of the way around the perimeter of the body 318. The housing 102 includes latching tabs 312 and blocking tabs 314 disposed on the first and second side 316, 320 of the body 318 and are elongated in a direction along the mating axis 140 between the first and second flanges 302, 322. The latching tabs 312 are disposed between the top side 324 and the blocking tabs 314.

The housing 102 includes a mating section 370 and a mounting section 380 between the front end 126 and the rear end 128. The mating section 370 of the housing 102 is secured to the panel 106 via the mounting clip 104. The mounting section 380 is secured to the circuit board 110. The mating section 370 extends between the mating or front end 126 and a mating surface 344 of a third flange 342. For example, the mating section 370 includes at least the alignment notches 332, 334, 346, the latching tabs 312, the blocking tabs 314, and the first and second flanges 302, 322. In the illustrated embodiment, the mating section 370 has a width or a size that is less than the width or size of the opening 118 of the panel 106. For example, the mating section 370 of the housing 102 has a shape and size that allows the mating section 370 to extend through the opening 118 of the panel 106 from the rear side 114 to the front side 112. Additionally, the mating section 370 has a width or size that is less than a width or size of a passage of the mounting clip 104. For example, the mating section 370 is sized in order to be received within the passage of the clip 104. The housing 102 may also include one or more crush bumps or features that may interfere with the opening 118 of the panel 106 to provide a tight or press fit between the housing 102 and the opening 118.

The mounting section 380 extends between the third flange 342 and the rear end 128 along the mating axis 140. When the housing 102 is coupled with the panel 106, the mating section 370 (e.g., from the front end 126 to the mating surface 344 of the third flange 342) extends through the opening 118 of the panel 106 from the rear side 114 to the front side 112 of the panel 106. The third flange 342 has a shape and size that prohibits the mounting section 380 from extending through the opening 118 when the housing 102 is coupled with the panel 106 in the loading direction 142 from the rear side 114 to the front side 112 (of FIG. 2).

Figure 4:
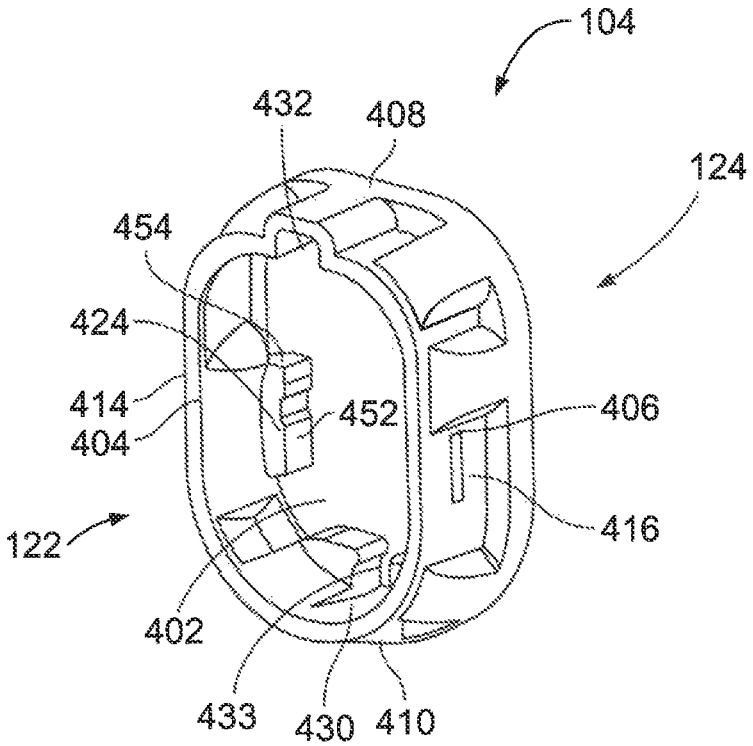
FIG. 4 is a perspective view of a mounting clip in accordance with an exemplary embodiment.
Figure 5A:
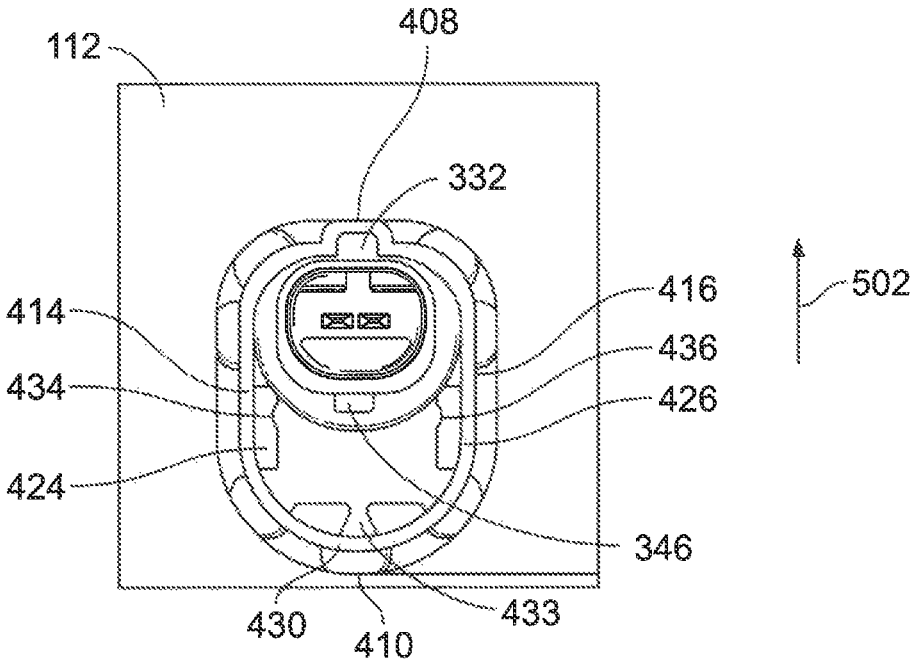
FIG. 5A is a front view of the mounting clip of FIG. 5 in an unlocked position in accordance with an exemplary embodiment.
Figure 5B:
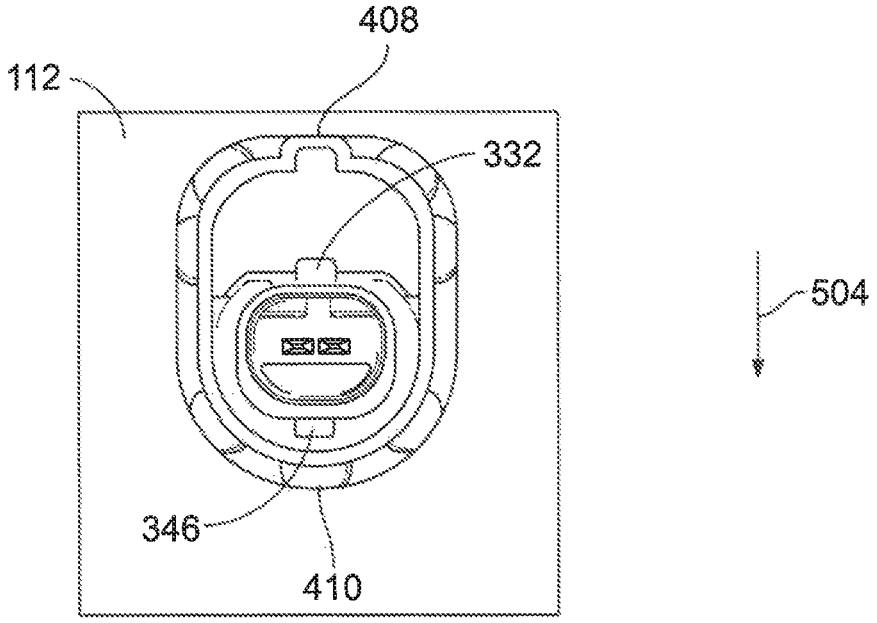
FIG. 5B is a front view of the mounting clip of FIG. 5 in a locked position in accordance with an exemplary embodiment.

FIG. 4 is a perspective view of the mounting clip 104 in accordance with an exemplary embodiment. FIG. 5A is a front view of the mounting clip in an unlocked position. FIG. 5B is a front view of the mounting clip in a locked position. The mounting clip 104 includes the body 138 that extends between the front end 122 and the rear end 124 with a passage 402 extending therethrough. The body 138 includes a first side 404 and a second side 406. The first and second sides 404, 406 are connected by a top side 408 and a bottom side 410. In various embodiments, the body 138 of the mounting clip 104 is in the shape of a ring, or an elongated ring, with the passage 402 extending therethrough. In the illustrated embodiment, the mounting clip 104 has a substantially elliptical cross-sectional shape. Optionally, the body 138 may have any alternative shape and/or size, may be devoid the top or the bottom sides 408, 410, or the like.

The mounting clip 104 includes an alignment notch 432 that is disposed at the top side 408 of the mounting clip 104 and an alignment notch 433 that is disposed at the bottom side 410 of the mounting clip 104. The alignment notch 432 is shaped and sized such that the alignment notch 432 aligns with the reciprocating alignment notches 332, 334 of the housing 102. The alignment notch 433 is shaped and sized such that the alignment notch 433 aligns with a reciprocating alignment notch 356 of the housing 102 and allows the alignment notch 356 of the housing to pass through the mounting clip 104. For example, the alignment notches 432, 433 of the mounting clip 104 orient the mounting clip 104 with respect to the housing 102 when the mounting clip 104 is coupled with the housing 102. Optionally, the mounting clip 104 may include any number of alignment notches or other types of alignment features.

The mounting clip 104 also includes an anti-rotation feature 430. In the illustrated embodiment, the anti-rotation feature 430 is disposed near the bottom side 410 of the mounting clip 104 and engages with the a protrusion (not shown) of the housing 102. The anti-rotation feature 430 extends into the passage 402 a distance away from an interior surface of the mounting clip 104 and engages with the housing 102. For example, the anti-rotation feature 430 prohibits the mounting clip 104 from rotating relative to the panel 106 when the mounting clip 104 is coupled with the housing 102. Alternatively, the anti-rotation feature 430 may have any alternative shape and/or size, may be disposed at any alternative position on the mounting clip 104, may be disposed on the housing 102, or the like.

The mounting clip 104 includes the first side 404 of the clip 104 and the second side 406 of the clip 104. The first side 404 and the second side 406, along with the top and bottom sides 408, 410, define the passage 402 that extends through the clip 104 between the front end 122 and the rear end 124 of the clip 104. The first side 404 includes a first locking feature 424 that extends away from the first side 404 and into the passage 402. Similarly, the second side 406 includes a second locking feature 426 that extends away from the second side 406 and into the passage 402. The locking features 424, 426 are connected to an interior surface of the mounting clip 104 by long sides 452 and extend into the passage 402 by a length of short sides 454. For example, the longer dimension of the long sides 452 of each of the locking features 424, 426 extends along the interior surface and the shorter dimension of the short sides 454, relative to the longer dimension of the long sides 452, extends a distance into the passage 402 and away from the interior surface of the mounting clip 104. The short sides 454 may also be referred to as top and bottom sides of the locking features 424, 426, and the long sides may also be referred to as interior and exterior sides of the locking features 424, 426.

The first locking feature 424 includes a first pocket 434 that is disposed on the long side 452 of the first locking feature 424. Additionally, the second locking feature 426 includes a second pocket 436 that is disposed on the long side 452 of the second locking feature 426. In the illustrated embodiment, the first and second pockets 434, 436 are recesses that extend into the long sides 452 of each locking feature 424, 426 and extend into each locking feature 424, 426. The first and second pockets 434, 436 are shaped and sized in order to maintain a position of the housing 102 inside the mounting clip 104 on the front side 112 of the panel 106.

The mounting clip 104 is moved in the mounting direction 144 (of FIG. 2) in order to engage with the front end 126 of the housing 102 that extends from the front side 112 of the panel 106. The alignment notch 432 of the mounting clip 104 is aligned with the alignment notches 332, 334 of the housing 102 in order to orient the mounting clip 104 with respect to the housing 102. Illustrated in FIG. 5A, the mounting clip 104 is in an unlocked position. For example, when the mounting clip 104 is in the unlocked position, the front end 126 of the housing 102 is able to move in and/or out of the opening 118 of the panel 106 (e.g., move in the loading direction 142 or the mounting direction 144 of FIG. 2). Illustrated in FIG. 5B, the mounting clip 104 is in a locked position. The mounting clip 104 in the locked position maintains a position of the housing 102 to the panel 106. For example, when the mounting clip 104 is in the locked position, the front end 126 of the housing 102 is coupled with the mating electrical assembly 120 and the mounting clip 104 and the housing 102 are not able to move away from the panel 106.

The mounting clip 104 is moveable between the unlocked position and the locked position by assembling or disassembling the mating electrical connector 120 with the housing 102 and sliding the rear end 124 of the mounting clip 104 along the front side 112 of the panel 106. For example, the locking features 424, 426 may provide a primary locking or retention force that maintains a position of the mounting clip 104 in the unlocked or locked positions. In the illustrated embodiment, the mounting clip 104 is moveable by sliding the clip 104 in a linear direction 502 to move the clip 104 to the locked position. The linear direction 502 is substantially perpendicular to the mating axis 140 of the housing 102. Optionally, the mounting clip 104 may move in a direction that is radial to the mating axis 140. Additionally, the clip 104 is moveable by sliding the clip 104 in a linear direction 504 (e.g., that is opposite the direction 502) to move the clip 104 to the unlocked position. For example, the front end 126 of the housing 102 and the passage 402 of the mounting clip 104 are sized and shaped to allow the clip 104 to move by translating the clip 104 in the linear directions 502, 504 when the front end 126 is received within the passage 402.

Additionally, the clip 104 may be moved between the unlocked and locked positions in a single or common plane. For example, the mounting clip 104 may move between the unlocked and locked positions by sliding the mounting clip 104 along the panel 106 while the rear end 124 of the clip 104 remains in contact with the panel 106. In one or more embodiments, the mounting clip 104 may be moved between the unlocked and locked positions without disrupting a position of the housing 102 and/or while reducing a stress that may be applied onto a solder joint of the housing 102 by the translation of the mounting clip 104.

When the mounting clip 104 is moved from the unlocked position to the locked position, the first and second locking features 424, 426 engage with the housing 102 to secure the housing 102 to the panel 106. The body 138 of the mounting clip 104 flexes, bends, expands, or the like, outward to allow the first and second locking features 424, 426 to bypass the housing 102 as the clip 104 is moved between the unlocked and locked positions. In the illustrated embodiment, the mounting clip 104 is shaped and sized such that the features of the mounting clip 104 may shift positions (e.g., flex, bend, or the like), due to the flexibility of the mounting clip 104, when the mounting clip 104 moves between the unlocked and the locked positions. In the illustrated embodiment, the mounting clip 104 includes plural load distributors that are shaped, sized, and disposed around the perimeter of the body 138 to distribute a loading force of a mounting action substantially evenly around the perimeter of the mounting clip 104. For example, the load distributors or features distribute a load on the mounting clip 104 as the body 138 of the mounting clip 104 bends or flexes.

In response to the clip 104 moving by sliding in the direction 502, the latching tabs 312 of the housing 102 interfere with the first and second locking features 424, 426. Additionally, the blocking tabs 314 may maintain a vertical position of the mounting clip 104 as the clip 104 moves in the direction 502. The latching tabs 312 interfering with the first and second locking features 424, 426 cause the body 138 of the mounting clip 104 to flex outward in a direction away from the passage 402. For example, the body 128, including the first and second sides 404, 406, expands or flexes outward from the passage 402 in order to increase a width of the passage 402 between the first and second locking features 424, 426. When the clip 104 is in the locked position, the latching tabs 312 are disposed within the first and second pockets 434, 436 and the body 138 of the mounting clip 104 returns to an unflexed state. Additionally, when the clip 104 is in the locked position, the blocking tabs 314 may engage with a top surface of the alignment notch 433 such that the top surface prevents movement of the mounting clip 104 in the direction 504.

The latching tabs 312 of the housing 102 engage with the first and second pockets 434, 436, respectively, of the first and second locking features 424, 426 when the mounting clip 104 is in the locked position. For example, the latching tabs 312 extend into the first and second pockets 434, 436 and maintain a position of the mounting clip 104. The mating electrical connector 120 is assembled to the front end 126 of the housing 102 and prevents the mounting clip 104 from disengaging from the housing 102. For example, the alignment notches 332 of the housing 102 latch onto one or more reciprocating latching features of the mating electrical assembly 120 and secure the components of the electrical assembly 100 together. Optionally, the housing 102 and/or the mounting clip 104 may have any alternative locking or latching mechanism that prohibits the mounting clip 104 from moving from the locking position to the unlocking position. Additionally, the anti-rotation feature 430 of the mounting clip 104 receives a protrusion of the housing 102 when the mounting clip 104 is in the locked position. The anti-rotation feature 430 prevents the mounting clip 104 and/or the housing 102 to rotate in a direction about the mating axis 140 of the housing 102.

The latching tabs 312 received within the pockets 434, 436 of the locking features 424, 426 maintain a position of the mounting clip 104 in the locked position. When the mounting clip 104 is in the locked position and the mating electrical connector 120 is assembled to the front end 126 of the housing 102, the mounting clip 104 cannot disengage from the housing 102. For example, the mating electrical connector 120 prevents the mounting clip 104 from moving in the direction 504 (e.g., to the unlocked position), prevents the mounting clip 104 from moving in the loading direction 142 (of FIG. 2) away from the front side 112 of the panel 106, and prevents the housing 102 from moving in the mounting direction 144 (of FIG. 2) away from the rear side 114 of the panel 106. Alternatively, when the mating electrical connector 120 is disassembled from the front end 126 of the housing 102, the mounting clip 104 can move in the direction 504 (e.g., to the unlocked position), the mounting clip 104 may move in the loading direction 142 (of FIG. 2), and the housing 102 may move in the mounting direction 144 (of FIG. 2) away from the rear side 114 of the panel 106.

In the illustrated embodiment, the latching tabs 312 engaging with the pockets 434, 436 of the locking features 424, 426 provides an engagement force that is substantially equivalent to a disengagement force. For example, the latching features of the mounting clip 104 and corresponding latching features of the housing 102 are shaped and sized such that an engagement force to hold the mounting clip 104 in the locked position is substantially similar to a disengagement force to move the mounting clip 104 from the locked position to the unlocked position. For example, when the mating electrical connector 120 is not coupled with the housing 102, the mounting clip 104 can engage and disengage (e.g., move between the locked and unlocked positions) with approximately the same or substantially the same amount of force. In alternative embodiments, the latching features of the mounting clip 104 and the corresponding latching features of the housing 102 may be shaped such that the mounting clip 104 moves between the locked and unlocked positions with different forces. For example, an engagement force to hold the mounting clip 104 in the locked position may be greater or less than a disengagement force to move the mounting clip 104 from the locked position to the unlocked position.

In alternative embodiments, the mounting clip 104 may be coupled to the housing 102 by rotating rather than sliding the mounting clip 104 to a locked position. For example, the mounting clip 104 may be rotated about the mating axis 140 to engage with the front end 126 of the housing 102 and to secure the housing 102 to the panel 106. The mounting clip 104 may be rotated about the mating axis 140 in a single or common plane. For example, the mounting clip 104 may move between the unlocked and locked positions by rotating the clip 104 and without moving the clip 104 between two or more different planes as the clip 104 rotates (e.g., in a non-helical path). Additionally, the mounting clip 104 may be moved between the unlocked and locked positions in the single or common plane and without disrupting a position of the housing 102 and/or while reducing an amount of stress that may be applied onto a solder joint of the housing 102 by the rotation of the mounting clip 104. Optionally, the mounting clip 104 may have any alternative shape and/or size and may secure the housing 102 to the panel 106 by sliding the mounting clip 104 in any translating, linear, or rotating direction.

Figure 6:
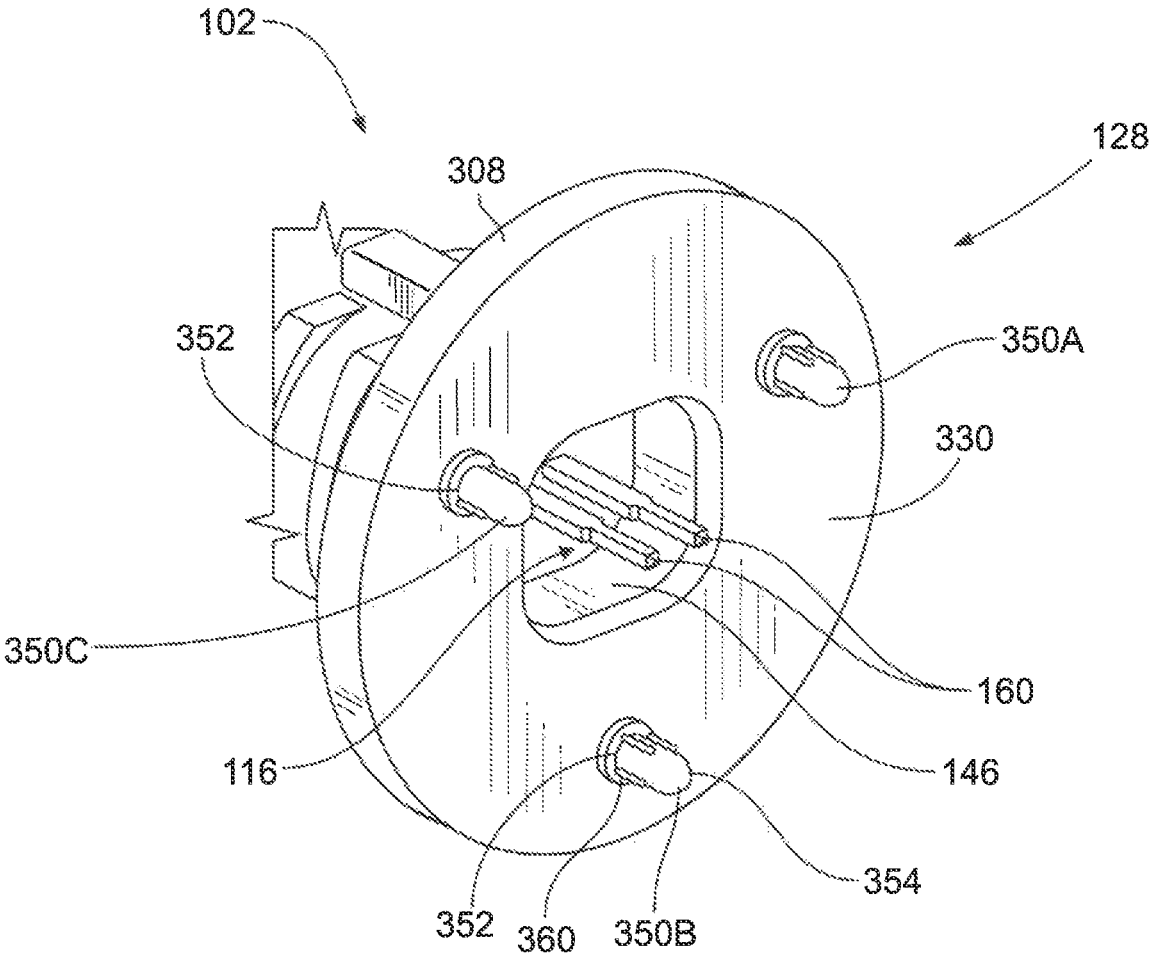
FIG. 6 is a rear view of the housing of FIG. 3 in accordance with an exemplary embodiment.

FIG. 6 is a perspective rear view of the housing 102. The housing 102 includes a rear flange 308 that includes a mating surface 330 at the rear end 128 of the housing 102. The mating surface 330 is configured to be coupled to the front side 130 of the circuit board 110 when the electrical assembly 100 is assembled. The housing 102 includes posts 350 for securing the housing 102 to the circuit board 110. The posts 350 have base ends 352 and free ends 354. The base ends 352 extend from the mating surface 330. The free ends 354 extend a distance away from the mating surface 330 in a direction along the mating axis 140. In the illustrated embodiment, the housing 102 includes a first post 350A, a second post 350B, and a third post 350C. Each of the three posts 350A-C have substantially the same shape and size and are positioned substantially symmetrically about the mating axis 140 relative to each other. Optionally, the housing 102 may include any number of posts 350 having any unique and/or common shapes and/or sizes. The posts 350 may be positioned about the mating axis 140 in any random or patterned configuration.

Each post 350 includes press-fit ribs 360 that extend along an exterior surface of the post 350. For example, the press-fit ribs 360 may extend longitudinally along the post 350. The press-fit ribs 360 may originate at or near the base end 352. The size (e.g., thickness) of the post 350 at the press-fit ribs 360 is larger than the size of the base of the post 350. The ribs 360 extend from a position near the base end 352 of each of the posts 350 in a direction towards the free end 354 in a direction along the mating axis 140. In an exemplary embodiment, the press-fit ribs 360 are crush-ribs. The press-fit ribs 360 are configured to be compressed in the circuit board 110 to hold the housing 102 in the circuit board 110.

In the illustrated embodiment, each of the posts 350 includes four ribs 360 that are substantially symmetrical in shape and size and are disposed about each of the posts 350. Optionally, each of the posts 350 may include any number of ribs 360, and each of the ribs 360 may have a unique shape and/or size, or the like. In an alternative embodiment, the posts 350 may be devoid the ribs, and instead may have a tapered shape and size between the base ends 352 and the free ends 354. In one or more embodiments, the ribs 360 may also be referred to as crush-ribs, interference ribs, or the like.

In an alternative embodiment, the first post 350A may include the ribs 360 but the second and third posts 350B, 350C may be devoid ribs 360. For example, the ribs 360 of the first post 350A may engage the interior surface of the corresponding passage to secure the housing 102 to the circuit board 110 and the second and third posts 350B, 350C may not engage the interior surface of the corresponding passages.

The terminating ends 160 of the contacts 116 are accessible at the rear end 128 of the housing 102. In the illustrated embodiment, the terminating ends 160 extend through the sealant 134 and away from the rear end 128 of the housing 102. The terminating ends 160 are electrically connected to the circuit board 110. For example, the contacts 116 electrically connect the mating electrical assembly 120 with the circuit board 110. In an exemplary embodiment, the terminating ends 160 may be press fit to the front side 130 of the circuit board 110, such as in plated vias. Optionally, the terminating ends 160 may be soldered to the circuit board 110, such as to pads, traces, or vias of the circuit board 110.

Figure 7A:
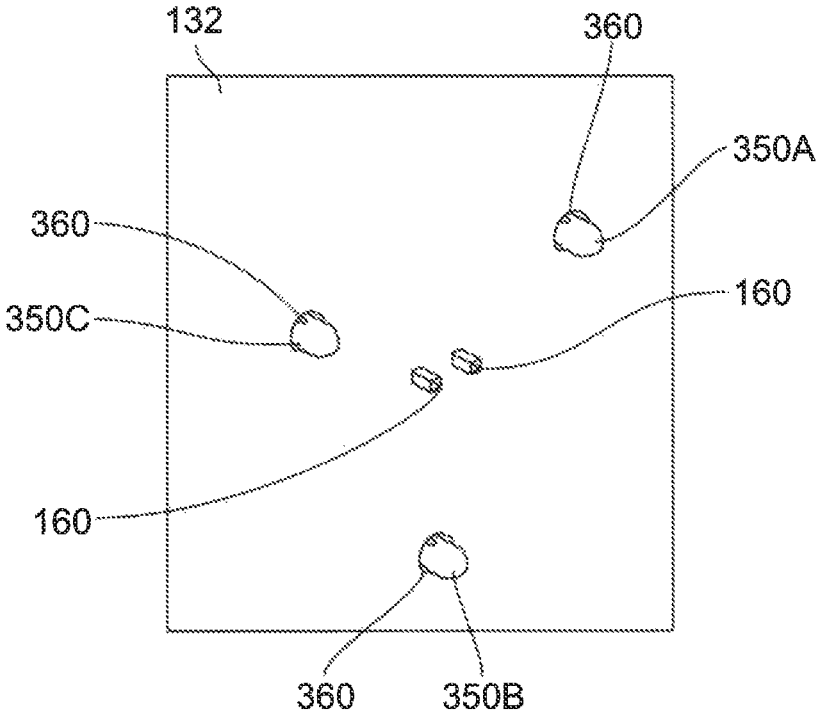
FIG. 7A is a rear view of posts after a primary locking operation in accordance with an exemplary embodiment.
Figure 7B:
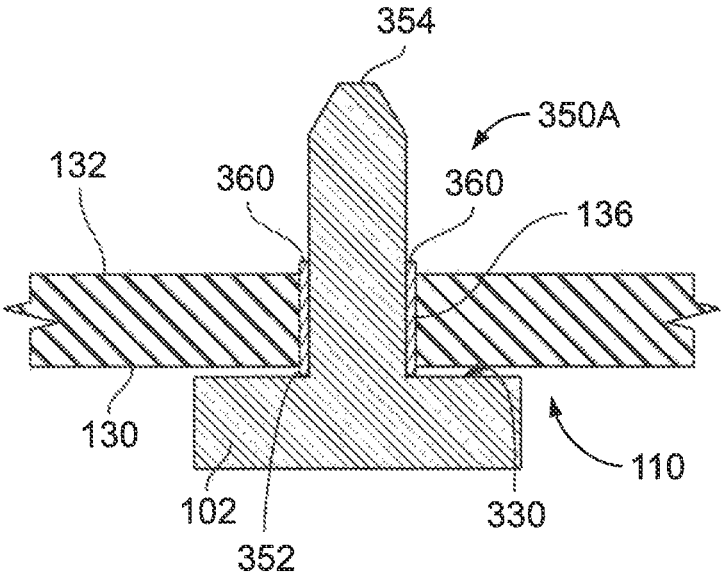
FIG. 7B is a cross-sectional view of a post of FIG. 7A after a primary locking operation in accordance with an exemplary embodiment.

FIG. 7A is a perspective rear view of the posts 350 press-fit into the circuit board 110 in accordance with an exemplary embodiment. FIG. 7B is a cross-sectional view of the first post 350A press-fit into the passage 136 of the circuit board 110. The posts 350 are loaded within the passages 136 from the front side 130 of the circuit board 110 to the rear side 132 of the circuit board 110. In the illustrated embodiment of FIG. 7A, each of the three posts 350 extend through the corresponding passage 136 of the circuit board 110 from the front side 130 to the rear side 132 of the circuit board 110. The posts 350 are press-fit into the passages 136 such that the press-fit ribs 360 of each of the posts 350 engage with each corresponding passage 136. For example, the press-fit ribs 360 engage an interior surface of the circuit board 110 within the passage 136 in a primary locking operation. Alternatively, the posts 350 and/or the passages 136 may have alternative corresponding shapes such as oval, rectangular, star, elliptical, or the like. In one embodiment, the ribs 360 may be deformed or crushed by press-fitting the posts 350 through the passages 136. In an alternative embodiment, the ribs 360 may deform the interior surfaces of the passages 136 by cutting into or grabbing onto the interior surfaces of the passages 136.

The primary locking operation temporarily secures the housing 102 to the circuit board 110. The posts 350 secure the housing 102 to the circuit board 110 by a primary holding force. The primary holding force between the press-fit ribs 360 engaged with the interior surface of the passages 136 maintains a position of the housing 102 assembled with the circuit board 110. In one or more embodiments, the primary holding force may also be referred to as a temporary holding force. For example, the press-fit ribs 360 engaging with the interior surface of the circuit board 110 within the passages 136 temporarily secures the housing 102 to the circuit board 110.

As illustrated in FIG. 7B, the first post 350A extends a pre-deformed length from the base end 352 to the free end 354. The pre-deformed length of the first post 350A extends a distance away from the rear side 132 of the circuit board 110. For example, the free end 354 of the post 350A protrudes from the rear side 132 of the circuit board 110. As illustrated in FIG. 7B, the press-fit ribs 360 extend a length that is approximately half of the pre-deformed length of the posts 350. Optionally, the press-fit ribs 360 may extend any distance along the pre-deformed length of the posts 350. For example, the press-fit ribs 360 extend a length from about the base end 352 of the post 350A towards the free end 354 to about the rear side 132 of the circuit board 110. Optionally, one or more of the press-fit ribs 360 may extend along the posts 350 a distance away from the rear side 132 of the circuit board 110, may extend any distance along the pre-deformed length of the posts 350 between about the base end 352 to about the free end 354, or the like.

Figure 8A:
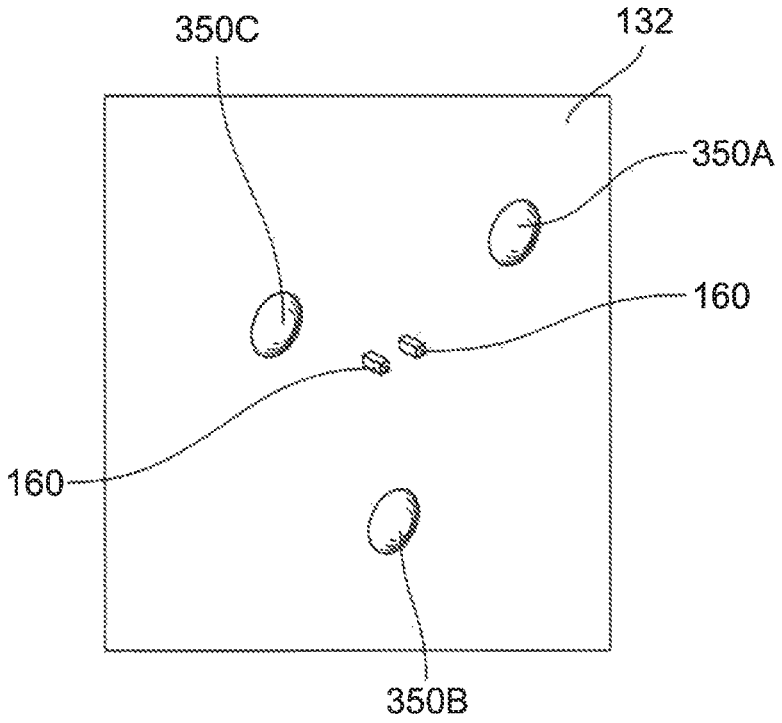
FIG. 8A is a rear view of the posts of FIG. 7A after a secondary locking operation in accordance with an exemplary embodiment.
Figure 8B:
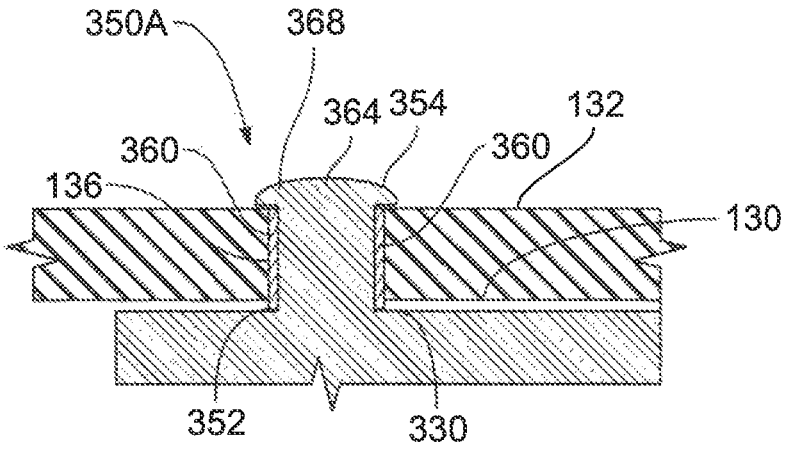
FIG. 8B is a cross-sectional view of a post of FIG. 8A after a secondary locking operation in accordance with an exemplary embodiment.

FIG. 8A is a rear view of the posts 350 after a secondary locking operation in accordance with an exemplary embodiment. FIG. 8B is a cross-sectional view of the first post 350A after a secondary locking operation. The secondary locking operation locks the free ends 354 of the posts 350 to the rear side 132 of the circuit board 110. In the illustrated embodiments of FIGS. 8A and 8B, the secondary locking operation is a staking operation. For example, the staking operation may be a thermoplastic staking operation such as heat-staking, ultrasonic staking, infrared staking, impulse staking, cold-forming, or the like.

The staking secondary locking operation deforms the free ends 354 of the posts 350. Deforming the free ends 354 enlarges the free ends 354 to form a blunt end 364 at the free end 354 of the posts 350. As illustrated in FIG. 8B, the free end 354 of the first post 350A is deformed by the staking operation and the blunt end 364 is formed at the free end 354 of the first post 350A. The blunt end 364 is larger than the passage 136 and restricts removal of the first post 350A back through the circuit board 110. For example, the blunt end 364 has a size (e.g., diameter) that is greater than the size (e.g., diameter) of the passage 136. In alternative embodiments, the blunt end 364 may have a shape that is unique to the shape of the passage 136 such that the shape of the blunt end 364 restricts removal of the first post 350A back through the circuit board 110.

The blunt end 364 creates a locking head 368 at the free end 354 of the first post 350A that engages with the rear side 132 of the circuit board 110 to lock the post 350A in the passage 136. The locking head 368 of the blunt end 364 secures the housing 102 to the circuit board 110 by a secondary holding force that is greater than the primary holding force. The secondary holding force by the blunt end 364 is greater than the primary holding force by the press-fit ribs 360. For example, the blunt ends 364 more securely holds the housing 102 assembled to the circuit board 110 relative to the lesser primary or temporary holding force of the press-fit ribs 360. Optionally, the free ends 354 may be deformed by any alternative method in order to change the shape of the free end 354 of each post 350 to lock the posts 350 to the rear side 132 of the circuit board 110.

In an exemplary embodiment, as illustrated in FIG. 7B, the first post 350A extends the pre-deformed length from the base end 352 to the free end 354 before the secondary locking operation. As illustrated in FIG. 8B, the first post 350A extends a post-deformed length from the base end 352 to the free end 354 after the secondary locking operation that is shorter than the pre-deformed length. For example, before the staking secondary locking operation, the posts 350 extend away from the rear side 132 of the circuit board 110. Alternatively, after the staking secondary locking operation, the free ends 354 of the posts 350 are deformed such that the blunt ends 364 are disposed near the rear side 132 of the circuit board 110. For example, the secondary locking operation reduces a length of the posts 350. Additionally, the press-fit ribs 360 extend approximately the post-deformed length of the posts 350 from the base ends 352 towards the free ends 354.

Figure 9:
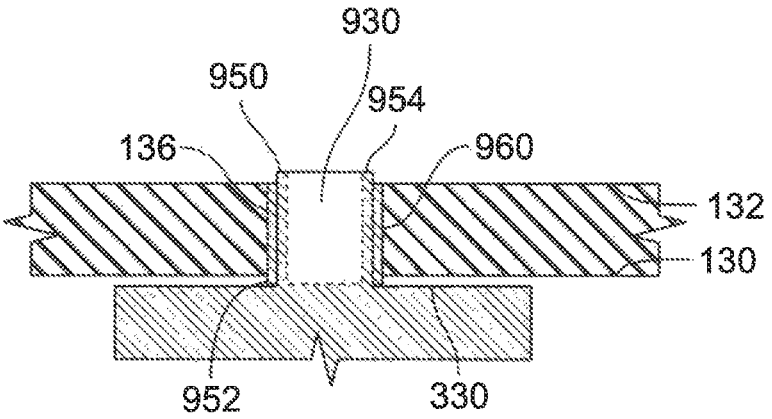
FIG. 9 is a cross-sectional view of a post after a primary locking operation in accordance with an exemplary embodiment.

The secondary locking operation may also be referred to as a permanent locking operation and the secondary holding force may also be referred to as a permanent locking force. The primary locking operation temporarily secures the housing 102 to the circuit board 110. The subsequent secondary locking operation permanently secures the housing 102 to the circuit board 110. The primary holding force of the primary locking operation (e.g., press-fitting the posts 350 within the passages 136) is less than the secondary holding force of the secondary locking operation (e.g., deforming the free ends 354 of the posts 350). FIG. 9 is a cross-sectional view of a post 950 press-fit into the passage 136 of the circuit board 110 in accordance with an exemplary embodiment. The post 950 is similar to the post 350 shown in FIG. 7A, however the free end 954 of the post 950 does not extend away from the rear side 132 of the circuit board 110. Alternatively, the post 950 extends a length between the base end 952 and the free end 954 that is approximately the length of the passage 136 that extends through the circuit board 110. The post 950 includes press-fit ribs 960 that engage with an interior surface of the circuit board 110 within the passage 136. For example, the press-fit ribs 960 engage the circuit board 110 in a primary locking operation of press-fitting the post 950 inside the passage 136. Press-fitting the post 950 within the passage 136 secures the housing 102 to the circuit board 110 by a primary holding force. The post 950 also includes an internal pocket 930 that is open at the free end 954 and extends a distance towards the base end 952 inside the post 950. In an exemplary embodiment, the internal pocket 930 may include a locking feature such as threads, a clamp, a fastener, threaded inserts, rivets, or the like.

Figure 10:
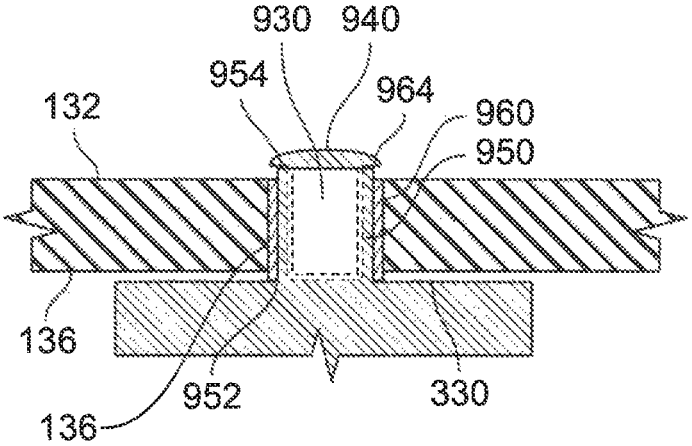
FIG. 10 is a cross-sectional view of the post of FIG. 9 after a secondary locking operation in accordance with an exemplary embodiment.

FIG. 10 is a cross-sectional view of the post 950 after a secondary locking operation in accordance with an exemplary embodiment. The secondary locking operation consists of coupling a fastener 940 with the post 950 to lock the free end 954 of the post 950 to the rear side 132 of the circuit board 110. The fastener 940 may be a screw, a rivet, a bolt, or the like, that engages with the locking feature of the internal pocket 930 to secure the fastener 940 to the post 950. The fastener 940 includes a blunt end 964 that has a size that is larger than the size of the passage 136. For example, the blunt end 964 of the fastener 940 engages with the rear side 132 of the circuit board 110 and restricts removal of the post 950 back through the circuit board 110. The fastener 940 secures the housing 102 to the circuit board 110 by a secondary holding force that is greater than the primary holding force. For example, the primary holding force of the press-fit ribs 960 engaging with the passage 136 is less than the secondary holding force of the blunt end 964 of the fastener 940 engaging with the rear side 132 of the circuit board 110. In an alternative embodiment, the post 950 may be locked to the rear side 132 of the circuit board 110 by an alternative secondary locking operation.

In an alternative embodiment, the posts 350 may not be deformed by a secondary locking operation, and the press-fit ribs 360 may retain the housing 102 to the circuit board 110. For example, in a less harsh environment, the press-fit ribs 360 may maintain a position of the housing 102 coupled to the circuit board 110, relative to a more harsh environment in which the press-fit ribs 360 alone cannot maintain a position of the housing 102 coupled to the circuit board 110. For example, in the more harsh environment, the secondary locking operation of staking the posts 350 provides a greater secondary holding force than the primary holding force of the press-fit ribs 360.

In an alternative embodiment, the secondary locking operation of staking the posts 350 may not provide a great enough holding force to maintain a position of the housing 102 coupled to the circuit board 110. For example, in an even harsher environment, the secondary locking operation of securing the fasteners 940 within the internal pockets 930 of the posts 950 provides a secondary holding force that may be greater than a secondary holding force of the staked posts, and may be greater than the primary holding force of the press-fit ribs 360.

Figure 11:
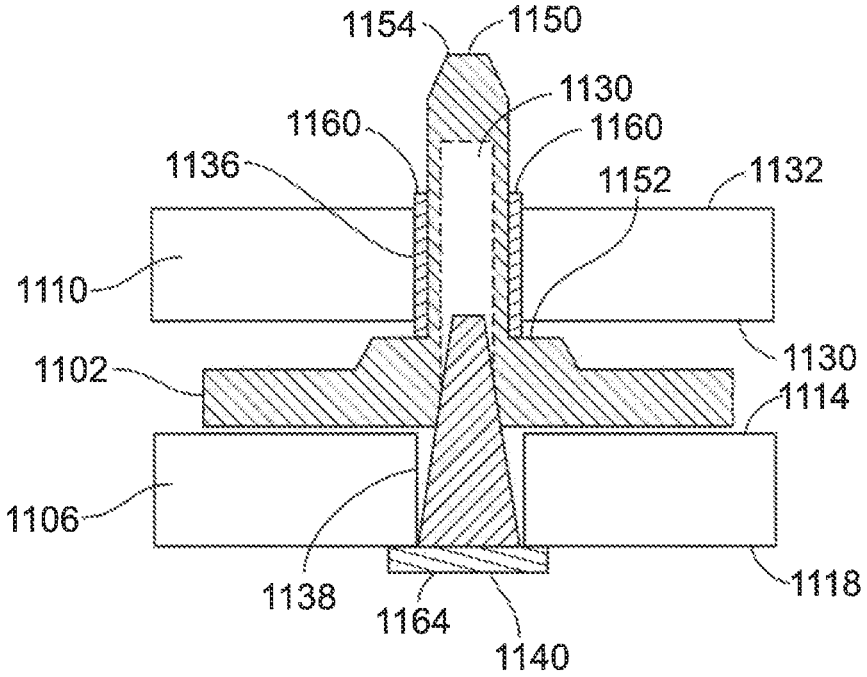
FIG. 11 is a cross-sectional view of a post after a primary locking operation and after a secondary locking operation in accordance with an exemplary embodiment.

FIG. 11 is a cross-sectional view of a post 1150 press-fit into a passage 1136 of a circuit board 1110 and after a secondary locking operation in accordance with an exemplary embodiment. The post 1150 is similar to the post 950 shown in FIG. 9, however a pocket 1130 extends through the housing 1102 and into the base end 1152 and a distance towards the free end 1154. In the illustrated embodiment, the post 1150 is closed at the free end 1154. In alternative embodiments, the post 1150 may be open at the free end 1154. Press-fit ribs 1160 engage the circuit board 1110 within a passage 1136 and secures the housing 1102 to the circuit board 1110 by a primary holding force.

In an exemplary embodiment, a secondary locking operation may hold the housing 1102 to the circuit board 1110 by a secondary holding force that may be greater than the primary holding force. For example, the secondary locking operation may consist of staking the free end 1154 of the post 1150. Deforming the free ends 1154 enlarges the free ends 1154 to form a blunt end at the free end 1154 that restricts removal of the posts 1150 back through the circuit board 1110. Alternatively, the secondary locking operation may consist of coupling a fastener to the free end 1154 of the post 1150.

In the illustrated embodiment, the housing 1102 is also coupled to the panel 1106. For example, a tertiary locking operation consists of coupling a fastener 1140 with the post 1150 to lock the housing 1102 to a panel 1106. The panel 1106 is similar to the panel 106 shown in FIG. 1, however the panel 1106 includes a passage 1138 extending therethrough from a front side 1112 to a rear side 1114. The fastener 1140 includes a blunt end 1164 that has a size that is larger than the size of the passage 1138. The fastener 1140 secures the housing 1102 to the panel 1106 by a tertiary holding force that is greater than the primary holding force. In the illustrated embodiment of FIG. 11, the housing 1102 is coupled to the circuit board 1110 by primary and secondary locking operations, and the housing 1102 is mounted to the panel 1106 by a separate tertiary locking operation. In alternative embodiments, the housing 1102 may be mounted to or coupled with the circuit board 1110, the panel 1106, and or any alternative connector, mounting surface, or the like, by any combination of locking operations.

At least one technical effect of the electrical assembly described herein is a housing that has posts that are sized and shaped to be secured to a circuit board. The posts of the housing, rather than posts of known housings, are shaped to be press-fit into passages of the circuit board and secure the housing to the circuit board by a primary holding force. A secondary locking operation locks the posts to the circuit board and secured the housing to the circuit board by a secondary holding force that is greater than the primary holding force. The secondary locking operation may be staking the posts, assembling fasteners to the posts, or the like. Locking the housing to the circuit board improves the security of locking the housing to the circuit board.

The electrical assembly also provides additional configuration flexibility by allowing the posts of the housing to be locked to the circuit board by different manufacturing methods. For example, press-fit ribs (e.g., crush ribs) may provide a primary retention force that provides permanent retention of the housing to the circuit board for less harsh environments. The geometry of the posts of the present electrical assembly provide a secondary retention force for harsher environments. Alternative embodiments may also allow for a tertiary locking operation that may consist of coupling threaded fasteners or rivets to the electrical assembly for even more harsh environments. For example, the electrical assembly may be secured by the primary locking operation, the secondary locking operation, and the tertiary locking operation. Additionally, the additional configuration flexibility allows the housing to lock to different circuit boards having different thicknesses from each other.

As used herein, relative or spatial terms such as "upper," "lower," "inner," "outer," "front," and "back" are only used to distinguish the referenced elements and do not necessarily require particular positions or orientations relative to gravity and/or the surrounding environment of the electrical assembly 100.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. An electrical assembly configured to be mounted to a circuit board having a front side and an opposite rear side with a passage extending therethrough, the electrical assembly comprising:

a housing including a body extending between a front end and a rear end, the front end having a mating section configured to be mated with a mating electrical assembly, the rear end including a mounting section that is larger than the mating section and having a mating surface configured to be coupled to the front side of the circuit board, the mounting section having posts extending around therefrom, each of the posts extending between a base end at the mating surface and a free end disposed a distance away from the mating surface, wherein the post has a constant diameter surface extending axially from the mating surface to the free end that is smaller in diameter than the passage, wherein the constant diameter surface includes a surface feature extending radially outwardly therefrom to cause the post to have a diameter sized greater than a diameter of the passage, wherein the housing is configured to be disposed on the front side of the circuit board such that the post is loaded into the passage of the circuit board and engages the circuit board in a primary locking operation such that the post surface feature is configured to secure the housing to the circuit board by a primary holding force; and a contact received in the housing, the contact having a mating end and a terminating end, the mating end accessible at the front end of the housing for mating with the mating electrical assembly, the terminating end accessible at the rear end of the housing for electrical connection with the circuit board, wherein the free end of the post is configured to be locked to the rear side of the circuit board by a secondary locking operation, the secondary locking operation is configured to secure the housing to the circuit board by a secondary holding force that is greater than the primary holding force.

2. The electrical assembly of claim 1, wherein the secondary locking operation consists of staking the free end of the post.

3. The electrical assembly of claim 1, wherein the free end of the post extends a distance away from the rear side of the circuit board when the post is received within the passage.

4. The electrical assembly of claim 1, wherein the secondary locking operation deforms the free end of the post to enlarge the free end of the post to form a blunt end, the blunt end being larger than the passage to restrict removal of the post back through the circuit board.

5. The electrical assembly of claim 1, wherein the post surface feature comprises a press-fit rib extending along the post, wherein the press-fit rib is configured to engage with an interior surface of the circuit board within the passage when the post is press-fit within the passage.

6. The electrical assembly of claim 1, wherein the post extends a pre-deformed length from the base end to the free end before the secondary locking operation, and wherein the post extends a post-deformed length between the free end and the base end after the secondary locking operation that is shorter than the pre-deformed length.

7. The electrical assembly of claim 1, wherein the post includes an internal pocket open at the free end of the post and extending a distance towards the base end, wherein the internal pocket includes a locking feature.

8. The electrical assembly of claim 7, further comprising a fastener coupled to the post, the fastener engaging the locking feature of the internal pocket.

9. The electrical assembly of claim 1, wherein the post is a first post and the passage is a first passage, the circuit board further comprising a second passage and the housing further comprising a second post extending between a base end at the mating surface and a free end extending a distance away from the mating surface, wherein the first passage receives the first post and the second passage receives the second post, the second post being locked to the circuit board separate from the first post by an independent secondary locking operation for the second post.

10. The electrical assembly of claim 9, wherein the free ends of the first and second posts are configured to be concurrently locked to the rear side of the circuit board by the secondary locking operations.

11. An electrical assembly configured to be mounted to a circuit board having a front side and an opposite rear side with a passage extending therethrough, the electrical assembly comprising:

a housing including a body extending between a front end and a rear end, the front end having a mating section configured to be mated with a mating electrical assembly, the rear end including a mounting section that is larger than the mating section and having a mating surface configured to be coupled to the front side of the circuit board, the mating section having posts extending around therefrom, each of the posts extending between a base end at the mating surface and a free end disposed a distance away from the mating surface, wherein the post has a constant diameter surface extending axially from the mating surface to the free end that is smaller in diameter than the passage, wherein the constant diameter surface includes a surface feature extending radially outwardly therefrom to cause the post to have a diameter along the surface features sized greater than a diameter of the passage, wherein the housing is configured to be disposed on the front side of the circuit board such that the post is loaded into the passage of the circuit board and engages the circuit board in a primary locking operation such that the post surface feature is configured to secure the housing to the circuit board by a primary holding force; and a contact received in the housing, the contact having a mating end and a terminating end, the mating end accessible at the front end of the housing for mating with the mating electrical assembly, the terminating end accessible at the rear end of the housing for electrical connection with the circuit board, wherein the free end of the post is configured to be locked to the rear side of the circuit board by a secondary locking operation, the secondary locking operation is configured to secure the housing to the circuit board by a secondary holding force that is greater than the primary holding force, wherein the secondary locking operation consists of staking the free end of the post.

* * * * *